US007712587B2

(12) United States Patent
Kim et al.

(10) Patent No.: US 7,712,587 B2
(45) Date of Patent: May 11, 2010

(54) ELEVATOR SYSTEM AND METHOD OF MONITORING ELEVATORS BY USING A VIRTUAL ELEVATOR GROUP

(75) Inventors: Sung Sub Kim, Gyeonggi-do (KR); Ki Hyun Nam, Seoul (KR); Pai Hun Hahn, Seoul (KR)

(73) Assignee: Otis Elevator Company, Farmington, CT (US)

( * ) Notice: Subject to any disclaimer, the term of this patent is extended or adjusted under 35 U.S.C. 154(b) by 514 days.

(21) Appl. No.: 11/816,541

(22) PCT Filed: Feb. 17, 2006

(86) PCT No.: PCT/US2006/006068

§ 371 (c)(1),
(2), (4) Date: Aug. 17, 2007

(87) PCT Pub. No.: WO2006/089282

PCT Pub. Date: Aug. 24, 2006

(65) Prior Publication Data

US 2008/0264732 A1 Oct. 30, 2008

(30) Foreign Application Priority Data

Feb. 18, 2005 (KR) ..... 10-2005-0013512

(51) Int. Cl.
*B66B 1/34* (2006.01)

(52) U.S. Cl. ..... 187/391; 187/382; 187/394; 187/247

(58) Field of Classification Search ..... 187/247, 187/248, 380–388, 391–396
See application file for complete search history.

(56) References Cited

U.S. PATENT DOCUMENTS

| | | | | |
|---|---|---|---|---|
| 6,330,935 | B1 | 12/2001 | Systermans | |
| 6,345,697 | B1 * | 2/2002 | Siikonen | 187/382 |
| 6,672,431 | B2 * | 1/2004 | Brand et al. | 187/382 |
| 6,978,863 | B2 * | 12/2005 | Hikita | 187/382 |
| 7,004,289 | B2 | 2/2006 | Shrum, III et al. | |
| 7,036,635 | B2 | 5/2006 | Rintala et al. | |

* cited by examiner

*Primary Examiner*—Jonathan Salata
(74) *Attorney, Agent, or Firm*—Carlson, Gaskey & Olds PC

(57) ABSTRACT

The present invention relates to a method and an elevator system for monitoring elevators by using a virtual elevator group. The method for monitoring elevators in an elevator system including a plurality of elevators classified into a plurality of elevator groups, and at least one virtual elevator group including a plurality of elevators, at least one of which is included in a different elevator group and displaying the elevator related information on the elevators included in the selected virtual elevator group.

11 Claims, 3 Drawing Sheets

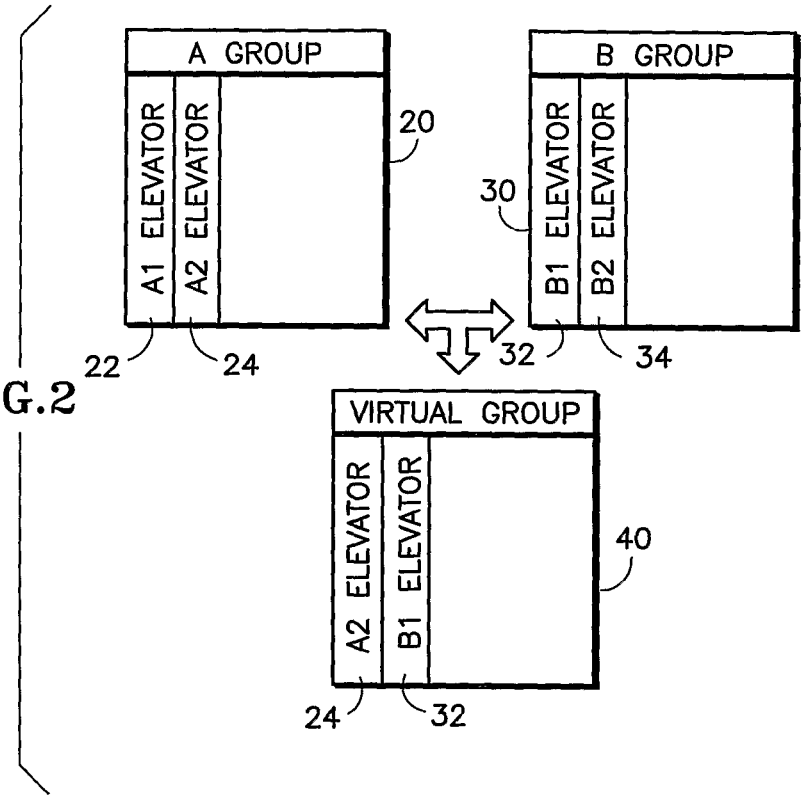
FIG.2
FIG.3
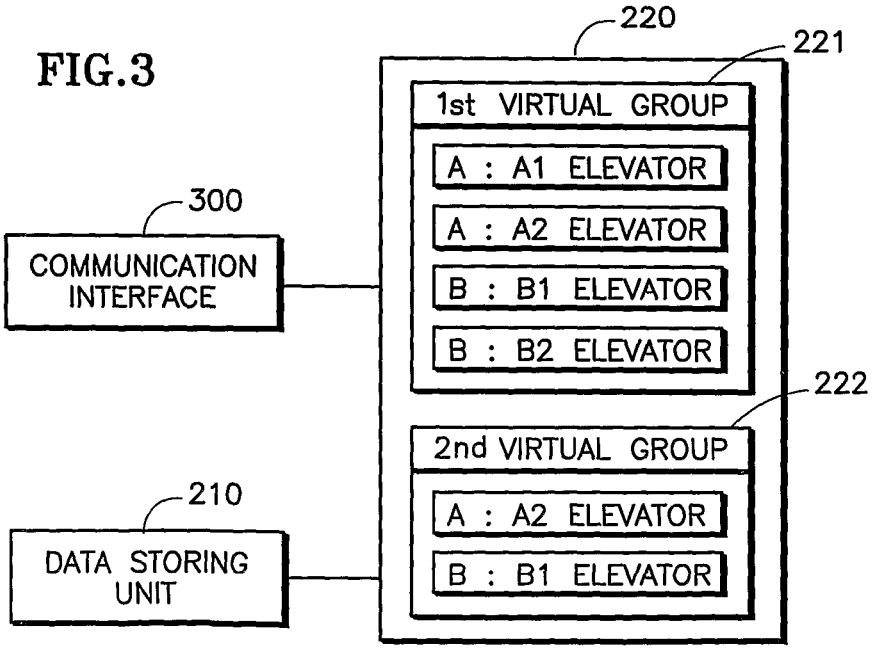

ELEVATOR SYSTEM AND METHOD OF MONITORING ELEVATORS BY USING A VIRTUAL ELEVATOR GROUP

FIELD OF THE INVENTION

The present invention generally relates to an elevator system including a plurality of elevators, and more particularly to an elevator system for monitoring elevators by using a virtual elevator group.

BACKGROUND OF THE INVENTION

An elevator system is a moving means that conveniently carries passengers upstairs or downstairs. A common elevator system includes an elevator monitoring device capable of constantly monitoring elevators so as to safely carry the passengers to a target floor.

The elevator monitoring device receives operation information related to the current service floor, moving direction of the elevator, elevator moving status, hall/car call registered floor and the like, as well as control information related to movement to a specific floor, parking of the elevator and the like. Such information is received from a control unit of each elevator, thus enabling the elevators to be monitored in real time.

Generally, a plurality of elevators in the elevator system is classified into a plurality of elevator groups according to elevator characteristics for control and monitoring. Each elevator group includes at least one elevator. The conventional elevator monitoring device selects an arbitrary elevator group among the plurality of elevator groups and then displays various information on the elevators included in the selected elevator group through a monitoring screen.

When elevator-related information is displayed on the monitoring screen, the number of elevator groups that can be displayed is limited to one due to the limited size of the monitoring screen. Therefore, in order to monitor a specific elevator that is not included in the elevator group being currently displayed, the elevator group displayed on the monitoring screen must be switched to the elevator group, which includes that specific elevator.

If the elevator group displayed on the monitoring screen is changed, the elevators included in the previous elevator group cannot be monitored anymore. That is, it is impossible to monitor elevators of different elevator groups through one monitoring screen in the conventional elevator monitoring device.

Also, if setup values determining the service floors of each elevator are set differently from each other, there arises a problem in that the number of elevator groups must be set to as many as the number of elevators. Furthermore, in order to monitor each elevator, the monitoring screen must be changed as many times as the number of elevators.

In order to solve the above problems, a communication interface connecting each elevator group is employed to monitor elevators of different elevator groups through one monitoring screen. However, there is a problem in that an additional communication interface must be installed. Furthermore, since noise is generated due to the communication interface, it is difficult to obtain accurate elevator-related information.

SUMMARY OF THE INVENTION

It is, therefore, an objective of the present invention to provide an elevator monitoring method and an elevator system for effectively monitoring elevators of the same elevator group and/or different elevator groups without an additional communication interface by using a virtual elevator group.

In accordance with an aspect of the present invention, a method is provided for monitoring elevators in an elevator system including a plurality of elevators classified into a plurality of elevator groups, including the steps of: (a) setting at least one virtual elevator group including a plurality of elevators, at least one of which is included in a different elevator group; (b) receiving elevator-related information from the plurality of elevators; (c) selecting the virtual elevator group to be displayed on a monitoring screen; and (d) displaying the elevator-related information on the elevators included in the selected virtual elevator group.

In accordance with another aspect of the present invention, an elevator system including a plurality of elevators classified into a plurality of elevator groups is provided, including: a plurality of elevator controlling units for controlling the plurality of elevators; and an elevator monitoring device for setting at least one virtual elevator group according to the virtual elevator group setup information inputted by an operator, receiving elevator-related information from the elevator controlling units and monitoring the elevators by each virtual elevator group, wherein the virtual elevator group includes at least one elevator of a different elevator group.

BRIEF DESCRIPTION OF THE DRAWINGS

The above and other objects and features of the present invention will become apparent from the following description of preferred embodiments given in conjunction with the accompanying drawings, in which:

FIG. 2 is a block diagram illustrating a monitoring screen of an elevator displaying unit in accordance with the present invention;

FIG. 3 is a block diagram illustrating a virtual elevator group managing unit in accordance with the present invention;

DETAILED DESCRIPTION OF THE PRESENT INVENTION

Figure 1:
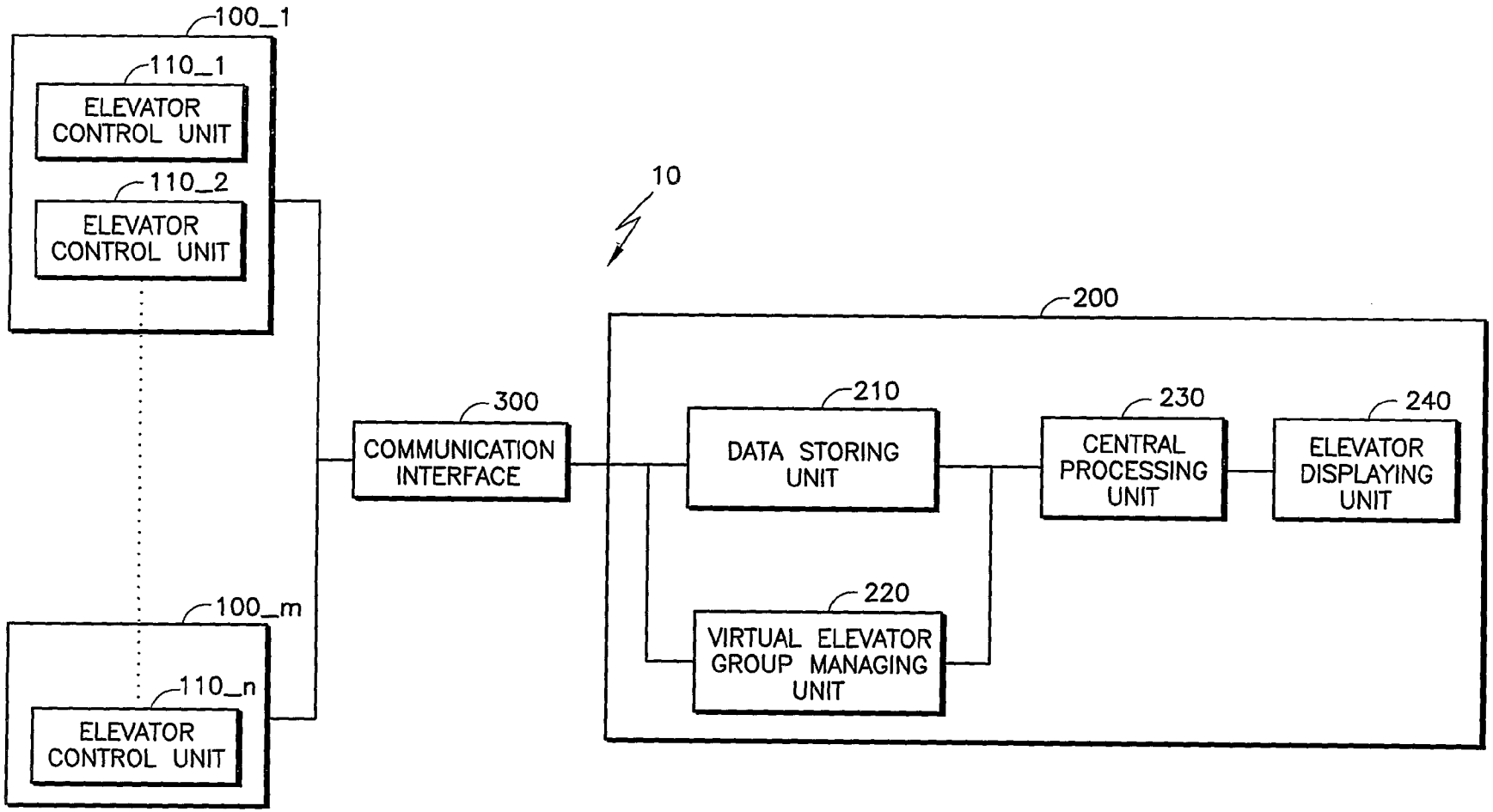
FIG. 1 is a block diagram showing an elevator system according to a preferred embodiment of the present invention.

FIG. 1 is a block diagram showing an elevator system according to a preferred embodiment of the present invention.

Referring to FIG. 1, elevator system 10 includes a plurality of elevators (not shown) classified into a plurality of elevator groups 100_1-100_*m*, a plurality of elevator control units 110_1-110_*n*, elevator monitoring device 200, and communication interface 300. Elevator control units 110_1-110_*n* for controlling run and stop operations of the elevators are assigned to the respective elevator groups or elevators.

Generally, the plurality of elevators are classified into a plurality of elevator groups according to elevator characteristics, and the plurality of elevators are controlled and monitored for each elevator group. Each elevator group includes at least one elevator. The elevator groups may be classified according to proximity or service floor. Elevator characteristics include types of elevators, elevator locations and service floors of the elevators, which become a reference for classifying the elevator groups. The elevator groups may be set upon establishing the elevators.

Elevator control units 110_1-110_*n* transmit elevator-related information to elevator monitoring device 200 through communication interface 300. Communication interface 300 exchanges data between elevator control units **110_1-110_*n* and elevator monitoring device 200. Elevator monitoring device 200 includes data storing unit 210, virtual elevator group managing unit 220, central processing unit 230, and elevator displaying unit 240. Data storing unit 210 stores elevator-related information received from the plurality of elevator control units 110_1-110_*n*** and virtual elevator group setup information.

Elevator-related information includes operation information related to the current service floor, moving direction of the elevator, elevator moving status, hall/car call registered floor and the like, as well as control information related to movement to a specific floor, parking of the elevator and the like.

Virtual elevator group setup information is inputted for monitoring the plurality of elevators desired by the operator through the monitoring screen of elevator displaying unit 240.

Virtual elevator managing unit 220 includes a storage unit (not shown) for storing elevator-related information of elevators included in the virtual elevator groups based on the virtual elevator group setup information stored in data storing unit 210. Virtual elevator managing unit 220 receives the elevator-related information from elevator control units **110_1-110_*n*** and stores the elevator-related information by distributing the elevator-related information to corresponding virtual elevator groups.

Each virtual elevator group is set to include a plurality of elevators, at least one of which belongs to a different elevator group. Also, the virtual elevator group may be set in a plurality of ways, and an arbitrary elevator may be included in the plurality of virtual elevator groups. The number of virtual elevator groups and the number of elevators, which belong to the virtual elevator groups, may be appropriately adjusted based on the elevator system and performance of each elevator.

When an operator selects one of the elevator groups or virtual elevator groups, central processing unit 230 performs data conversions so as to display the information related to the elevators included in the selected elevator group on a monitoring screen of elevator displaying unit 240. Elevator displaying unit 240 displays the data-converted information received from central processing unit 230 through the monitoring screen.

FIG. 2 is a block diagram illustrating the monitoring screen of elevator displaying unit 230 in accordance with the present invention. Merely for the sake of convenience, it will be assumed that elevator group A consists of elevators A1 and A2, elevator group B consists of elevators B1 and B2, and a virtual elevator group includes elevators A2 and B1.

As shown in FIG. 2, information associated with elevators A1 and A2 is displayed on the first monitoring screen 20 and information associated with elevators B1 and B2 is displayed on the second monitoring screen 30. If the operator selects a first virtual elevator group, central processing unit 230 converts information associated with elevators A2 and B1 to data for display and transmits the data to elevator displaying unit 240. Thereafter, elevator displaying unit 240 displays the information associated with elevators A2 and B1, which belong to different elevator groups, on one monitoring screen as shown in the third monitoring screen 40.

FIG. 3 is a block diagram illustrating virtual elevator group managing unit 220 in accordance with the present invention. Virtual elevator group managing unit 220 sets and manages a plurality of virtual elevator groups 221 and 222 according to the virtual elevator group setup information stored in data storing unit 210. As shown in FIG. 3, elevator group A consists of elevators A1 and A2, and elevator group B consists of elevators B1 and B2. Virtual elevator group managing unit 220 sets a first virtual elevator group 221 and a second virtual elevator group 222 based on the virtual elevator group setup information stored in data storing unit 210.

As an example, the first virtual elevator group 221 consists of elevators A1, A2, B1 and B2, and the second virtual elevator group 222 consists of elevators A2 and B1. If the operator selects the first virtual elevator group 221, information associated with elevators A1, A2, B1 and B2 is displayed on the monitoring screen. Also, if the operator selects virtual elevator group 222, information associated with elevators A2 and B1 is displayed on the monitoring screen.

Data conversion for the elevator-related information received from the elevator control units is carried out in central processing unit 230 to be displayed at elevator displaying unit 240. The elevator-related information may be displayed in graphics or text on the monitoring screen of elevator displaying unit 240.

Figure 4:
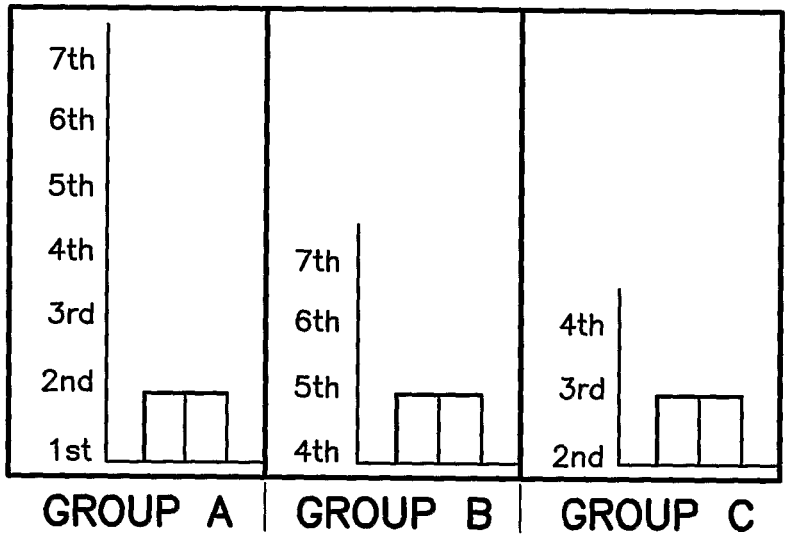
FIG. 4 is a schematic diagram showing an example of a monitoring screen displaying a virtual elevator group in accordance with the present invention.

FIG. 4 is a diagram showing a monitoring screen displaying a virtual elevator group in accordance with the preferred embodiment of the invention. FIG. 4 shows the monitoring screen graphically displaying a virtual elevator group, consisting of elevators arbitrarily selected from elevator groups A, B and C, which have been classified based on the service floors of the elevators. The monitoring screen shows that the service floors of elevator group A are from the first floor to the seventh floor, the service floors of elevator group B are from the fourth floor to the seventh floor, and the service floors of elevator group C are from the second floor to the fourth floor. The elevators included in the virtual elevator group are displayed on the same monitoring screen in accordance with the preferred embodiment of the present invention.

The service floors of the elevators displayed on the monitoring screen are determined according to a service floor indicating value included in the elevator-related information transmitted from the elevator control units.

Generally, when the service floor of each elevator is the lowest service floor, central processing unit 230 sets the service floor indicating value as "1." That is to say, when the service floor indicating value is "1," it means that the service floor of the elevators in elevator group A is the first floor, the service floor of the elevators in elevator group B is the fourth floor, and the service floor of the elevators in elevator group C is the second floor.

Whenever the service floor of the elevator goes up by one floor from the lowest service floor, central processing unit 230 increases the service floor indicating value by one, so that the elevators are displayed in graphics on the monitoring screen for the service floors.

When the service floor indicating value is "1," even if the service floors are different from each other, the service floor of each elevator may be displayed at a position indicating the same service floor on the monitoring screen.

Accordingly, when elevators in elevator groups whose lowest service floors are different are displayed on one monitoring screen in accordance with another embodiment of the present invention, an adding value is set for each elevator. The adding value is determined according to a reference floor. The reference floor may be set to the lowest service floor among the lowest service floors of the elevators.

For example, when the first floor is defined as the reference, the adding value of each elevator is set based on the difference between the lowest service floor of the elevator and the reference floor. Since the lowest service floor of the elevators included in elevator group A, operating from the first floor to the seventh floor, is the first floor and the reference floor is the first floor, the adding value becomes "0." Also, the adding value of the elevators included in elevator group B, operating from the fourth floor to the seventh floor, is set to "3," and the adding value of the elevators included in elevator group C, operating from the second floor to the fourth floor, is set to "1."

When the lowest service floor of the elevator is lower than the first floor, the elevator service floor indicating value may be expressed with a negative sign (–). In such a case, the adding value, which is determined according to the difference between the lowest service floor of the elevator and the reference, is indicated as an absolute value.

Figure 5:
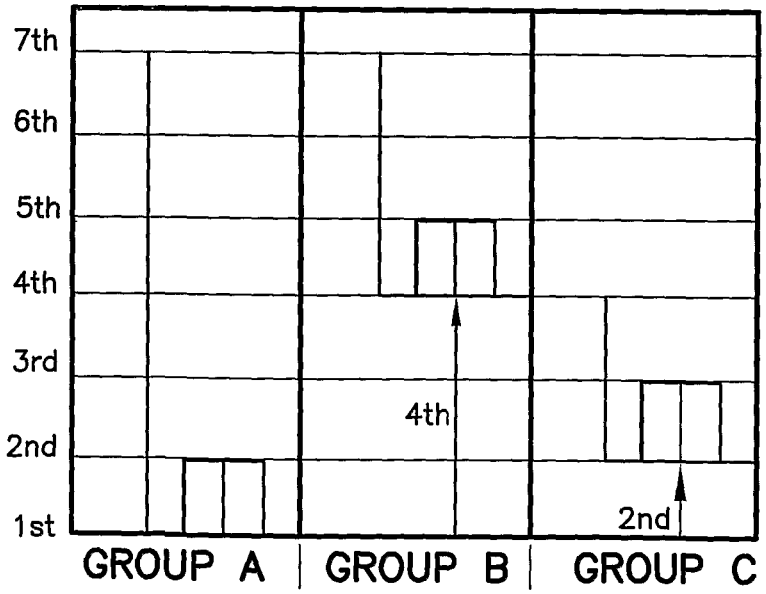
FIG. 5 is a schematic diagram showing an example of a monitoring screen displaying elevators having different lowest service floors, which are aligned by substantial service floors.

After setting the adding value for each elevator group, the service floor of the elevator is displayed by adding the adding value to the elevator service floor indicating value on the monitoring screen. Therefore, when elevators having different lowest service floors are positioned at the respective lowest service floors, the lowest service floors of the elevators are not aligned at the same position on the monitoring screen of elevator displaying unit 240, as shown in FIG. 5.

As the virtual elevator group is set to include a plurality of elevators in which at least one of the elevators is included in a different elevator group in the elevator system, a plurality of elevators included in different elevator groups can be monitored without changing the monitoring screen.

Also, since an additional communication line does not need to be established to connect each elevator group in order for elevators included in different elevator groups to be displayed on one monitoring screen, this system is cost effective and can solve the problem of communication noise, which may be generated due to the establishment of a communication line.

While the present invention has been described and illustrated with respect to a preferred embodiment of the invention, it will be apparent to those skilled in the art that variations and modifications are possible without deviating from the broad principles and teachings of the present invention which should be limited solely by the scope of the claims appended hereto.

What is claimed is:

1. A method for monitoring elevators in an elevator system including a plurality of elevators classified into a plurality of elevator groups, comprising the steps of:

(a) setting at least one virtual elevator group including a subset of the plurality of elevators, at least one of which is included in a different elevator group, storing virtual elevator group setup information, setting the virtual elevator group according to the stored virtual elevator group setup information;

(b) receiving elevator-related information from the subset of the plurality of elevators;

(c) selecting the virtual elevator group to be displayed on a monitoring screen; and (d) displaying the elevator-related information of the elevators included in the selected virtual elevator group.

2. The method as recited in claim 1, wherein step (a) includes the step of:

receiving and storing elevator-related information corresponding to the elevators included in the virtual elevator group.

3. The method as recited in claim 1, wherein the plurality of elevator groups are classified according to elevator characteristics, wherein the elevator characteristics include at least one of types of elevators, a physical elevator location and service floors of the elevators.

4. The method as recited in claim 2, wherein an arbitrary elevator belongs to the plurality of virtual elevator groups.

5. The method as recited in claim 1, wherein step (d) includes the steps of:

(d1) checking whether the lowest service floors of the elevators included in the selected virtual group are different;

(d2), if it is determined that the lowest service floors are different, setting a reference floor;

(d3) setting an adding value based on the difference between the lowest service floor for each elevator group and the reference floor; and (d4) displaying the service floor of each elevator by adding the adding value to an elevator service floor indicating value.

6. An elevator system including a plurality of elevators classified into a plurality of elevator groups, comprising:

a plurality of elevator controlling units for controlling the elevators; and an elevator monitoring device for setting at least one virtual elevator group according to virtual elevator group setup information inputted by an operator, receiving elevator-related information from the elevator controlling units and monitoring the elevators included in the respective virtual elevator groups, wherein the virtual elevator group includes at least one elevator of different elevator groups and wherein the plurality of elevator groups are classified according to elevator characteristics, wherein the elevator characteristics include at least one of types of elevators, a physical elevator location and service floors of the elevators.

7. The elevator system as recited in claim 6, wherein the elevator monitoring device includes:

a data storing unit for storing the elevator-related information received from the elevator controlling units and the virtual elevator setup information;

a virtual elevator group managing unit for setting the virtual elevator groups based on the virtual elevator group setup information, receiving the elevator-related information from the elevator controlling units, distributing the elevator-related information to corresponding virtual elevator groups; and an elevator displaying unit for displaying the elevator-related information on the elevators included in one of the virtual elevator groups on a monitoring screen.

8. The elevator system as recited in claim 7, wherein the elevator monitoring device further includes a central processing unit for performing data conversion of the elevator-related information of the elevators included in the virtual elevator group selected by the operator to be displayed on the monitoring screen of the elevator displaying unit.

9. The elevator system as recited in claim 7, wherein an arbitrary elevator belongs to the plurality of virtual elevator groups.

10. The elevator system as recited in claim 8, wherein the position of the elevator service floor displayed on the monitoring screen is determined based on the elevator service floor indicating value received from the elevator controlling units.

11. The elevator system as recited in claim 10, wherein the central processing unit checks whether the lowest service floors of the elevators included in the selected virtual elevator group are different from each other, and if the lowest service floors are different, sets an adding value for each elevator, and adds the adding value to the elevator service floor indicating value of each elevator.

* * * * *